United States Patent [19]

Dierks, deceased et al.

[11] 4,335,845

[45] Jun. 22, 1982

[54] CARRIER SHEET WITH ENVELOPE LETTER SHEET DEVICE SECURED THERETO

[76] Inventors: Raymond W. Dierks, deceased, late of Pelham Manor, N.Y.; by Nicholas Noviello, Jr., executor, 10 Ely Rd., Peekskill, N.Y. 10566; by Seymour Glass, executor, 57-11-260 St., Little Neck, N.Y. 11362

[21] Appl. No.: 133,332

[22] Filed: Mar. 24, 1980

[51] Int. Cl.[3] ..... B65D 27/10

[52] U.S. Cl. ..... 229/69; 229/73; 282/23 R; 206/232; 206/620

[58] Field of Search ..... 229/69, 73, 85, 92.7, 229/92.3; 282/23 R, 25, 11.5 A; 93/61 R, 61 A; 221/73; 206/232, 620, 804

[56] References Cited

U.S. PATENT DOCUMENTS

| | | | |
|---|---|---|---|
| 2,872,100 | 2/1959 | Coffin | 229/92.1 |
| 3,217,972 | 11/1965 | McNelis | 229/92.1 |
| 3,995,808 | 12/1976 | Kehoe | 229/73 |
| 4,081,127 | 3/1978 | Steidinger | 229/69 |
| 4,091,987 | 5/1978 | Cone | 229/69 |

*Primary Examiner*—George T. Hall

[57] ABSTRACT

A carrier sheet for automated typing or printing equipment has secured thereto a combined envelope-letter sheet device for sequential or simultaneous printing of the necessary information on the envelope and letter sheet and avoidance of match-merge collation problems with respect to proper pairing of addressed envelope and letter.

The envelope-letter sheet device includes a letter sheet extending from the rear sealed panel of the envelope to give a predetermined overlap of the letter sheet with the bottom of the envelope as required. The length of the envelope-letter sheet device can be tailored or adjustably predetermined by adjusting the amount of overlap. The overlap will cover the letterhead portion of the letter. The closure flap of the envelope may be left extended or is folded downwardly to reduce overall length before attachment of the device to the carrier sheet.

10 Claims, 3 Drawing Figures

CARRIER SHEET WITH ENVELOPE LETTER SHEET DEVICE SECURED THERETO

BACKGROUND OF THE INVENTION

1. Field of the Invention

This invention is concerned with a system to assure the correct relationship of an envelope and its enclosure while at the same time providing for a rapid printing of both the envelope and the enclosure.

More particularly, the present invention concerns a carrier sheet whereon an envelope-letter sheet device is removably secured. The envelope-letter sheet device is uniquely structured to have an adjustably predetermined length whereby it can provide a standard size 8½" by 11" letter sheet portion attached to a standard size No. 10 business envelope (9½"×4⅛"), both of which suitably fit on and within a single panel of a continuous carrier sheet. That is, the length of the envelope-letter sheet device can be adjustably predetermined or tailored to the carrier sheet panel irrespective of the size of the letter sheet and envelope.

2. Description of the Prior Art

It is known to attach either an envelope or a letter sheet to a continuous carrier sheet for feeding into typewriters, automatic printers, IBM printers, word processors, or the like. Such a carrier sheet usually sequentially carries and properly feeds into the printing device, the letter sheet or envelope attached thereto for rapid sequential printing or typing of the necessary information thereon.

Such an arrangement, although convenient and rapid, has a number of serious drawbacks. One serious disadvantage of the prior arrangement is the danger that addressed envelopes and letters will get out of sequence with respect to each other with all of the problems attendant thereto. If the insertion of letters into the envelope is automated, it is possible for error to be made so that complete series or part thereof will have a mismatched letter and envelope until such error is discovered. Even if the error is discovered immediately, there is an immense match-merge collating problem especially if the mis-sequencing is more than just a single letter out of place. In some instances, more than one letter and envelope will become out of place with each other so that it becomes difficult for an ordinary clerk to readjust the sequence. In any case, automated equipment for inserting the letters into the envelopes and sealing them will need to be reset at best, and may be useless.

A second disadvantage of the prior system is that it requires two separate runs through the printing or typing equipment to complete the job. Thereafter, the separately printed forms must be collated and the letters inserted into the proper envelopes by whatever means is used. This is a waste of printing or typing equipment time and requires the use of two separate carrier sheet packs to complete the job. Thus, there is unnecessary expense with respect to operating the printing or typing equipment and in the use of carrier sheet paper.

As noted heretofore, the present invention provides for a combined letter sheet and envelope device which is formed in a unique arrangement whereby each combined device can be tailored to fit on to the single carrier sheet panel. It is believed that such a uniquely designed envelope-letter sheet device is previously unknown, and in addition no one has previously combined such a device with a carrier sheet for automated use.

Combined envelope and letter sheet devices in general are known in the prior art. These have been designed for a multitude of purposes.

Prior art devices include the type of device wherein the message carrying portion is folded up to form the envelope itself, with the message written on the inside of the envelope. This type of device is generally shown, for example, in U.S. Pat. No. 1,583,867 to Benedict; U.S. Pat. No. 2,847,235 to Blumenthal and U.S. Pat. No. 2,600,146 to Whitman. Somewhat similar to these types of devices are the devices wherein an unfolded blank is provided whereon a message is written and thereafter the whole arrangement is folded up to form an envelope. These devices normally provide a message carrying portion which can be removed from the closed envelope without destroying the envelope. Thus, for example, U.S. Pat. No. 1,948,290 to Dygert et al shows an envelope blank which may be folded in one of several ways depending on whether the envelope is to be sent by first class mail or otherwise. U.S. Pat. No. 1,801,155 to Harson shows an accordian-like envelope arrangement wherein the letter sheet is folded before the envelope is sealed. The device shown in U.S. Pat. No. 1,591,231 to Otis is designed so that the written portion cannot be detached from the envelope without destroying part of the written portion. That is, the written portion extends over a flap of the envelope and the envelope thereafter is sealed. This is to provide evidence that an envelope did in fact, contain a notice when it was sealed.

Another general type of combined envelope-letter sheet device is one wherein the message portion remains attached to the envelope and may be wrapped or otherwise folded about the envelope to provide a different return address. That is, for example, to permit questionnaires to be conveniently returned to the proper address. U.S. Pat. No. 371,217 to Procter and U.S. Pat. No. 1,591,231 to Otis both show examples of this type of device.

Where it is desired to reproduce a name and address simultaneously on both the message portion and the envelope portion of a combined envelope-message portion type device, systems such as that shown in Pedersen U.S. Pat. No. Re.17,948, are known. If copies of the message are required, Blumenthal U.S. Pat. No. 2,847,235 provides a device which produces multiple carbon copies at the time the original message is being prepared.

Also known are letter-envelope combination devices wherein a letter sheet portion is secured to an envelope and may be detached for inclusion in the envelope after the envelope has been addressed and the message produced on the letter sheet portion thereof. U.S. Pat. No. 3,217,972 to McNelis is an example of such a device.

Thus, in this relatively crowded art wherein an envelope and message portion are combined in various ways, many specialized devices have evolved. However, no one has disclosed the use of these combined devices in combination with continuous carrier sheets for automated operation, nor has there been any disclosure as to how one would proceed to accomplish such an objective with the heretofore known devices.

Of interest with respect to the state of the art in the use of a continuous carrier sheet in addressing envelopes or other devices is U.S. Pat. No. 3,442,185 to Buescher. Buescher suggests that one can merely print the necessary material on a continuous carrier strip, or multiple layers of a continuous carrier strip and thereafter cut out the necessary shape from the carrier strip to form an envelope or other mailable device.

BRIEF DESCRIPTION OF THE INVENTION

Briefly, the present invention is in a standard line hole punched fanfolded carrier sheet to which is secured a unique envelope-letter sheet device for use especially in automated printing and typing procedures, and in the envelope-letter sheet design itself. The envelope, when closed, is a standard size No. 10 business envelope and the letter sheet portion may be a standard 8½" by 11" sheet. It is contemplated that the upper portion of the letter sheet will normally be printed with a letterhead. Because of the unique structure of the envelope-letter sheet, the envelope-letter sheet size can be tailored to match a single panel of a standard size carrier sheet. Other combinations of envelope and letter sizes can, in general, also be tailored to fit onto a predetermined standard line hole punched fanfolded carrier sheet panel.

In order to accomplish the sizing of the combined envelope-letter sheet device to a standard 11¾" by 14" carrier sheet panel, the envelope-letter sheet device is constructed with an overlap portion sized to permit receipt of the combined device on a single carrier sheet panel. This is accomplished by adjusting the size of the back panel of the envelope. The letter sheet is secured to the sealed back panel which forms the envelope structure. This sealed panel is sized to permit sufficient overlap of the envelope and letter sheet to permit the combined device to fit on a single carrier sheet panel. As the preferred device results in a business letter and envelope, the overlap preferably is sized to cover only the normally preprinted letterhead portion at the top of a business letter sheet. The closure flap, which is normally larger than the sealed flap, is folded over to save further space. The portion of the folded-over flap near the folded edge carries the releasable (fugitive) adhesive to secure that edge of the envelope to the carrier sheet. The free end of the letter sheet carries a similar (fugitive) adhesive for securing to the carrier sheet. Fugitive type adhesive is preferably used so that there is no evidence of the adhesive when the envelope-letter sheet is removed for mailing.

BRIEF DESCRIPTION OF THE DRAWINGS

For a fuller understanding of the invention reference is made to the detailed description thereof in conjunction with the drawings which are as follows.

DESCRIPTION OF THE PREFERRED EMBODIMENT

Figure 1:
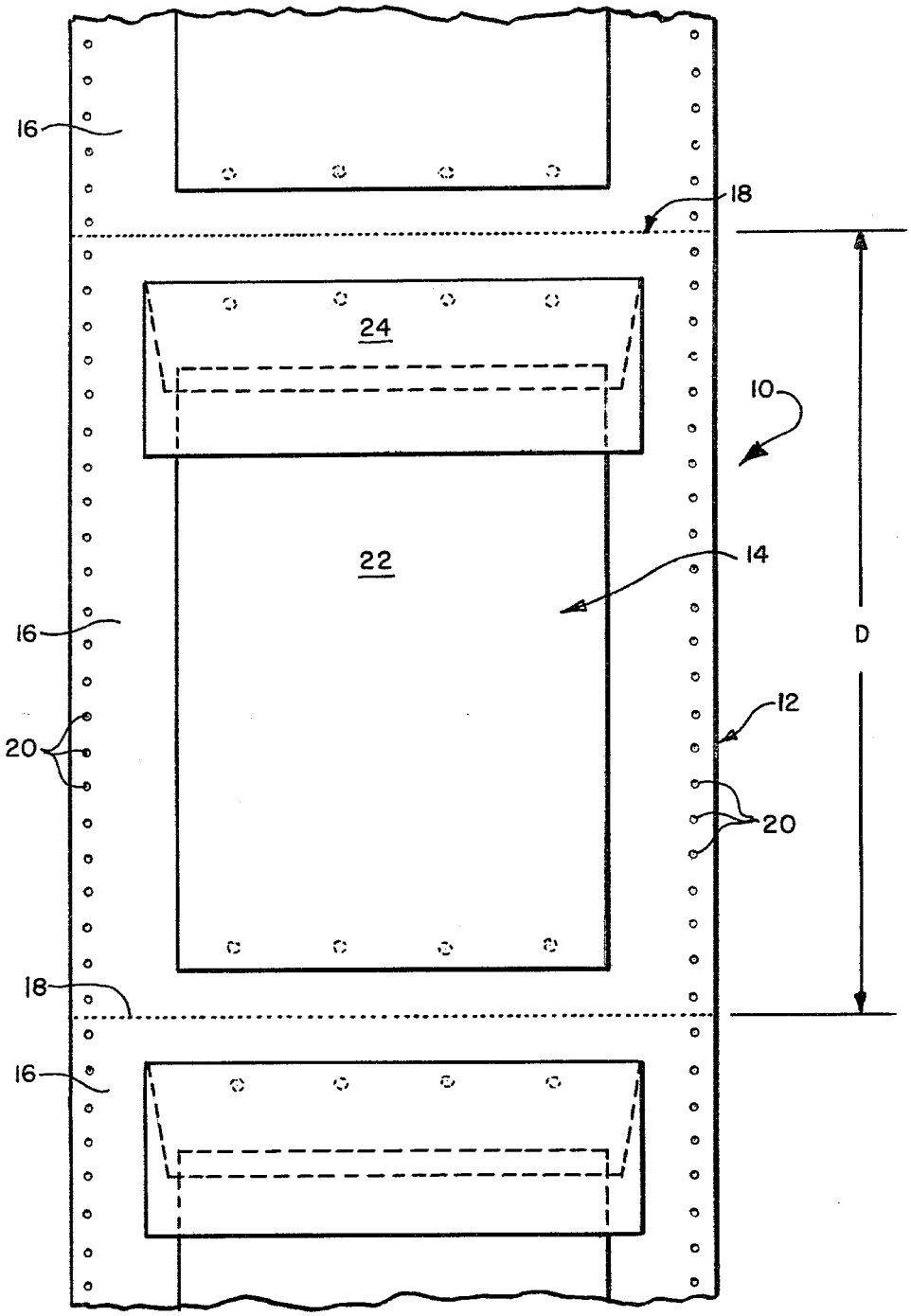
FIG. 1 is a front elevational view of the present invention showing the envelope-letter sheet device secured to a continuous carrier sheet strip.

With reference to FIG. 1, the present invention provides a carrier sheet system 10 for use with conventional automated printing and typewriting devices (not shown) whereby both an envelope and a letter sheet are delivered to the automatic printing or typing device, simultaneously, for operation thereon. This is accomplished by providing a continuous carrier sheet strip 12 on which is removably secured an envelope-letter sheet device 14. As the continuous carrier sheet 12 is fed into usual automated typing or printing devices, the envelope-letter sheet device 14 is delivered as required for printing.

As is usual, the continuous line hole punched fanfolded carrier sheet strip 12 is formed of a series of carrier sheet panels 16 which are about 11¾" wide by 14" long and separated by a line of perforations or paper ties 18. Along each elongated edge of the continuous carrier sheet strip 12 are standard ½" spaced line hole punchings with 5/32" sprocket holes 20 which are engaged by a pin feed tractor or sprocket (not shown) in the automatic printing devices for moving the continuous carrier sheet strip 12 therethrough.

Figure 2:
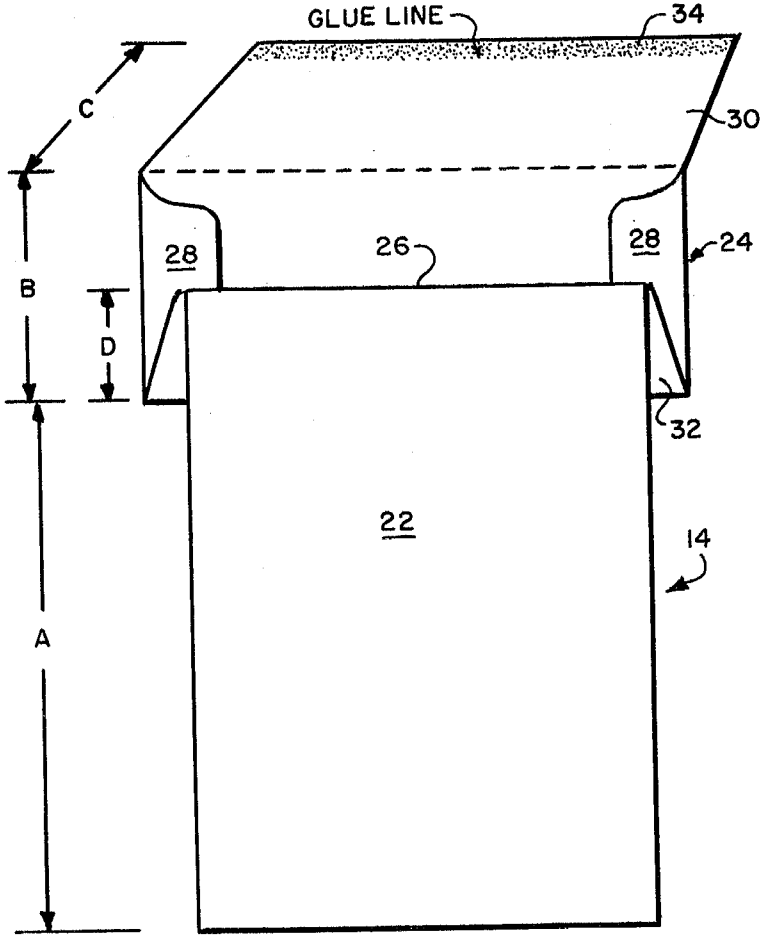
FIG. 2 is a rear view of the envelope-letter sheet device with the closure flap in partially open position, the continuous carrier sheet strip having been left off to show the details of the completed envelope-letter sheet device; and, FIG. 3 is a rear view of the blank from which the envelope-letter sheet device can be formed.

Because the present invention is intended especially for business use, a unique envelope-letter sheet device 14 was devised in order that both a standard No. 10 size envelope and a standard 8½" by 11" letter sheet would fit within the standard carrier sheet panel 16, normally sized about 11¾" by 14". A No. 10 envelope is normally about 9½" by 4⅛" high. The 9½" width will fit on an 11¾" wide carrier sheet without any problem, however, the combined height of the envelope of 4⅛" with the length of the letter sheet of 11" adds up to more than 15", which cannot be fit into a 14" space. Thus, the variable size envelope-letter sheet device 14, illustrated in FIGS. 1 and 2, is preferred. As illustrated, the envelope-letter sheet device includes a letter sheet portion 22, preferably pre-printed with an appropriate firm letterhead 21, and an envelope portion 24. The letter sheet portion 22 is separated from the envelope portion 24 by a line of perforations 26 or other structure weakening means to guide the separation of letter sheet portion 22 from envelope portion 24 after the printing, typing or other message forming operation is completed.

Figure 3:
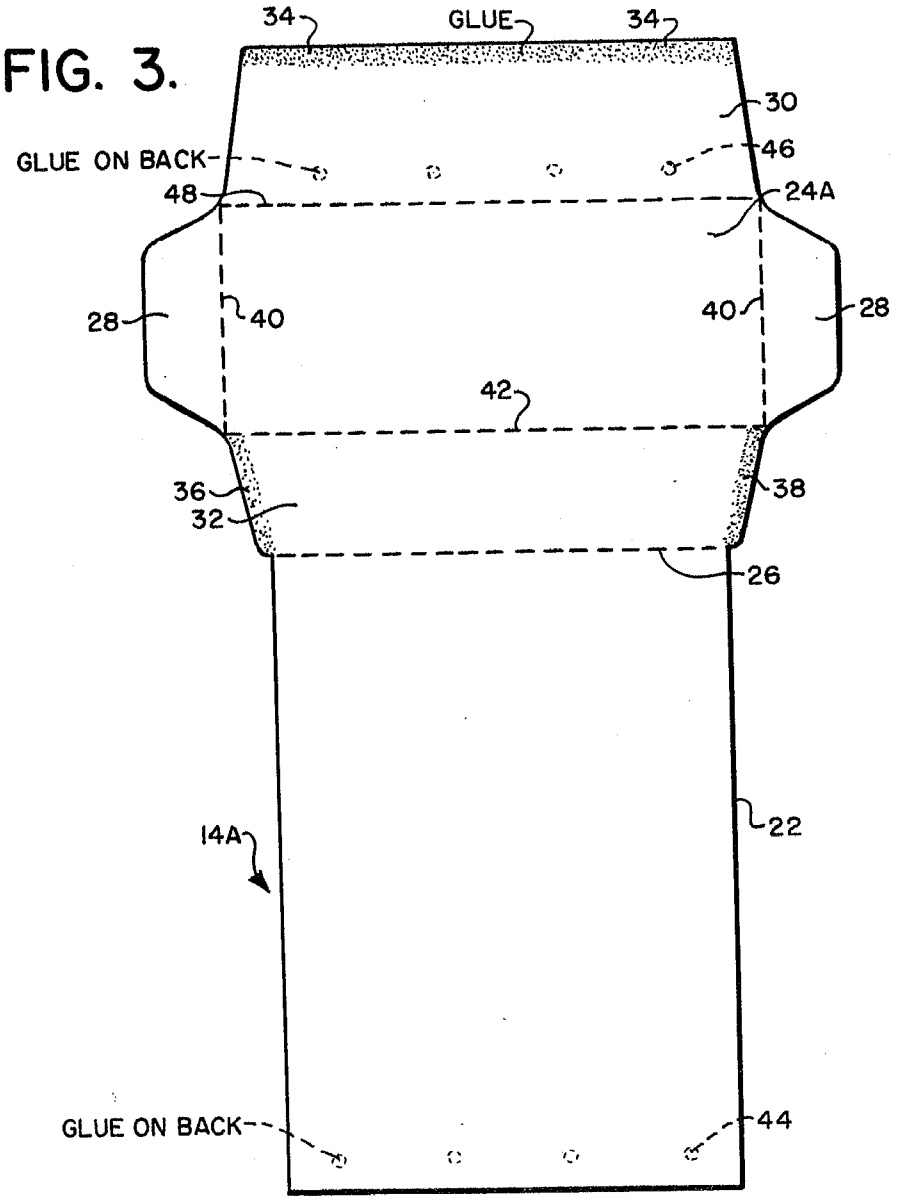

The envelope-letter sheet device 14 can be formed from a device blank 14A as illustrated in FIG. 3, or other suitable blank, subject to the structural requirements as discussed more completely in detail below, whereby the length of the device can be varied. Device blank 14A includes a letter sheet portion 22 and an unfolded envelope portion 24A. The unfolded envelope portion has side tabs 28, a closure flap portion 30 and a rear panel portion 32. The letter sheet portion 22 extends from the rear panel portion 32 and is separated therefrom by the line of perforations 26. The edge portion 34 of the device blank 14A, where closure flap portion 30 is defined, includes a strip or a series of strips of water activated adhesive exemplified by dotted outline 34. This line of water activated adhesive 34 is the "glue" that is moistened to seal the envelope after the letter 22 has been inserted therein.

Along the side edges of rear panel portion 32 are strips of adhesive exemplified by dotted outlines 36, 38 which are used to form the envelope. Depending on the process used, adhesive strips 36, 38 can be moisture- or heat-activated or the type of adhesive which operates with the evaporation of solvent. The nature of this adhesive depends on the method by which the envelope portion 24 will be assembled.

Assembly of the envelope which can be done by usual envelope assembly equipment, is by folding tabs 28, 28 inwardly along fold lines 40, 40. Thereafter, rear panel portion 32 is folded upwardly along fold line 42 to overlap side tabs 28. Glue strips 36, 38 are activated to seal rear panel portion 32 to the side tabs 28, 28, and the envelope portion 24 is thereby formed. As shown in FIG. 1, the upper letterhead portion 21 of the letter sheet 22 is overlapped by the envelope 24.

Two additional lines of adhesives are also required on device blank 14A whereby device blank 14A will be removably secured to carrier sheet 16. A first line of adhesive dots 44 is disposed near the free end of letter sheet portion 22, on the back side thereof, as shown in FIG. 3. A second line of adhesive dots 46 is disposed on the front of closure flap 30 near fold line 48 of closure flap 30. The adhesive used can be any of the usual adhesives employed to secure envelopes to carrier sheets for releasable support thereon. These adhesives are preferably well known and commercially available fugitive type adhesives that will leave no trace when the envelope-letter sheet is removed for use.

Before envelope-letter sheet device 14 can be secured to carrier sheet panel 16, it may be necessary to fold closure flap 30 downwardly into the closed position to reduce the length of the envelope-letter sheet device 14. If room on the carrier sheet 16 permits, flap 30 may be left unfolded. Closure flap 30 preferably is long enough to overlap the lines of perforations 26 between letter sheet 22 and envelope portion 24 by at least the width of glue strip 34, so that the envelope can be sealed. The line of fugitive adhesive dots 46 along the folded edge of flap 30 secures the device to carrier sheet 16. Equipment to accomplish this assembly process is commercially available if automation is required.

For the preferred embodiment wherein envelope portion 24 is to be a usual size No. 10 envelope and letter sheet portion 22 is to be a standard 8" by 11" or 8½" by 11" size letter sheet, the following dimensions must be observed. With reference to FIG. 2, the dimension "A" is the length of the letter sheet, normaly 11" to 11½". The length indicated by "B" is the height of the envelope, normally 4⅛". With reference to FIG. 1, "E" is the length of the carrier sheet panel 16, normally about 14". Because the length of the letter sheet "A" and the height of the envelope "B" normally total an amount greater than the length of the carrier sheet "E", the envelope-letter sheet device 14 has certain definite limitations placed on the minimum size of rear panel portion 32, designated "D". The length "C" of closure flap 30 as noted above, is preferably enough to close the envelope and to overlap rear panel portion 32 for sealing with adhesive 34.

In addition, as the size of rear panel portion 32 also determines the amount of the top of the letter sheet which is overlapped or covered, the maximum dimension for "D" is determined by the smallest normal printed letterhead size, about 2–3 inches. This will ensure that the message portion of the letter will not be separated from the firm letterhead by an extraordinary amount. Obviously, a longer letterhead, which extends beyond the overlap, will pose no problems in this respect.

The various dimensions are related as follows:

(1) A+B−D must be less than or equal to E (2) D+C is preferably greater than B (3) D should be no larger than a short printed letterhead, normally 2–3 inches.

As will readily be realized from comparing FIGS. 1 and 2, equation (1) must hold true for the envelope-letter sheet 14 of the present invention, to fit onto a single carrier sheet 16. Equation (2) is preferable to ensure that the envelope is completely closed, that is, the closure flap 34 overlaps back panel 32, for sealing the envelope.

Typically, an approximately ½" border is left at the top and at the bottom of the system 10 so that the line hole punched carrier sheet strip can be fanfoldedin an accordian style as is usual with continuous carrier sheet strips 12. Thus, it has been found that an envelope-letter sheet device wherein the rear panel portion 32 (dimension "D") is abut 2⅛" with a closure flap inexcess of 2⅝" (dimension "C") is suitable for use as part of the carrier sheet system 10 of the present invention. In such a case, the total length of the continuous carrier sheet strip with closure flap portion 30 folded downwardly for attaching to carrier sheet 16 will be, for an 11" letter sheet:

$$11''+4\tfrac{1}{8}''-2\tfrac{1}{8}''=13''.$$

As the carrier sheet is 14", this leaves ½" margin on each end of the device when it is centered on the carrier sheet. The size of the overlap portion covering the upper letterhead portion of the letter sheet is well within a satisfactory range.

The above is by way of illustration of the presently preferred embodiment and is not intended to be otherwise limiting. Thus, for example, the above calculations can be used to tailor various sized envelope-letter sheet devices to various sized carrier sheet panels other than the standard sizes noted herein. This is due to the unique adjustable design of the envelope-letter sheet device.

What is claimed is:

1. A carrier system comprising:

a continuous line hole punched fanfolded carrier sheet strip including sequentially aligned carrier sheet panels, each having a predetermined length;

an envelope-letter sheet device releasably secured to one of said carrier sheet panels and comprising a letter sheet portion and an envelope portion;

said envelope portion comprising a fixed rear panel having a length equal to a first distance and a closure flap portion;

said letter sheet portion extending from the free edge of said rear panel a second length equal to a second distance;

said envelope having a width greater than the width of said letter sheet and having a height equal to a third distance;

the sum of said second and said third distances, less said first distance, being equal to an amount less than the predetermined length of said continuous line hole punched fanfolded carrier sheet.

2. The system of claim 1 wherein:

said envelope portion has a width of about 9½ inches and a length of about 4⅛ inches; and said letter sheet has a width of about 8 to 8½ inches and a length of about 11 to 11½ inches.

3. The system of claim 1 or 2 wherein said letter sheet has a letterhead printed near its edge adjacent said rear panel, and said rear panel overlapping at least a portion of said printed letterhead.

4. The system of claim 1 or 2 wherein said continuous line hole punched fanfolded carrier sheet panels have a length of about 14 inches.

5. The system of claim 4 wherein said continuous line hole punched fanfolded carrier sheet strip includes a continuous line of regularly spaced 5/32 inch sprocket holes with a standard ½ inch spacing therebetween, along each edge thereof.

6. The system of claim 1 or 2 wherein said letter sheet portion contains a preprinted letterhead portion at the top thereof approximately equal in length to said length of said fixed rear panel, and wherein said preprinted letterhead portion of said letter sheet portion is covered by said fixed rear panel when said letterhead portion is folded downwardly along said free edge of said fixed rear panel.

7. The system of claim 3 wherein said letter sheet portion contains a preprinted letterhead portion at the top thereof approximately equal in length to said length of said fixed rear panel, and wherein said preprinted letterhead portion of said letter sheet portion is covered by said fixed rear panel when said letterhead portion is folded downwardly along said free edge of said fixed rear panel.

8. The system of claim 4 wherein said letter sheet portion contains a preprinted letterhead portion at the top thereof approximately equal in length to said length of said fixed rear panel, and wherein said preprinted letterhead portion of said letter sheet portion is covered by said fixed rear panel when said letterhead portion is folded downwardly along said free edge of said fixed rear panel.

9. The system of claim 5 wherein said letter sheet portion contains a preprinted letterhead portion at the top thereof approximately equal in length to said length of said fixed rear panel, and wherein said preprinted letterhead portion of said letter sheet portion is covered by said fixed rear panel when said letterhead portion is folded downwardly along said free edge of said fixed rear panel.

10. An envelope-letter sheet device to be releasably secured to a carrier sheet panel of predetermined length for automated operations, comprising:

a letter sheet portion; and an envelope portion;

said envelope portion comprising a fixed rear panel having a length equal to a first distance and a closure flap portion;

said letter sheet portion extending from the free edge of said rear panel a second length equal to a second distance;

said envelope having a width greater than the width of said letter sheet and having a height equal to a third distance;

the sum of said second and said third distances, less said first distance, being equal to an amount less than the predetermined length of the continuous line hole punched fanfolded carrier sheet.

* * * * *